US006086647A

United States Patent [19]

Rahm et al.

[11] Patent Number: 6,086,647

[45] Date of Patent: Jul. 11, 2000

[54] MOLASSES/OIL COAL TREATMENT FLUID AND METHOD

[75] Inventors: Randall L. Rahm; Kevin B. Avery, both of Gillette, Wyo.; Mark H. Berggren, Golden, Colo.

[73] Assignee: RAG Coal West, Inc., Gillette, Wyo.

[21] Appl. No.: 08/235,542

[22] Filed: Apr. 29, 1994

[51] Int. Cl.[7] ..... C10L 5/04; C10L 5/24

[52] U.S. Cl. ..... 44/620; 44/572; 44/602; 252/88.1

[58] Field of Search ..... 44/620, 602, 572; 252/88, 88.1

[56] References Cited

U.S. PATENT DOCUMENTS

| | | | |
|---|---|---|---|
| 1,886,633 | 11/1932 | Broeman | 44/545 |
| 2,098,232 | 11/1937 | Fife | 44/602 |
| 2,222,945 | 11/1940 | Groll et al. | 44/600 |
| 3,711,318 | 1/1973 | Trechock et al. | 44/602 |
| 3,985,516 | 10/1976 | Johnson et al. | 44/501 |
| 3,985,517 | 10/1976 | Johnson | 44/501 |
| 4,201,657 | 5/1980 | Anderson et al. | 208/23 |
| 4,265,637 | 5/1981 | Anderson | 44/282 |
| 4,331,445 | 5/1982 | Burns | 44/608 |
| 4,389,218 | 6/1983 | Pike | 44/530 |
| 4,421,520 | 12/1983 | Matthews | 44/501 |
| 4,501,593 | 2/1985 | Paersch et al. | 44/564 |
| 4,582,511 | 4/1986 | Siddoway et al. | 44/577 |
| 4,969,928 | 11/1990 | Wen et al. | 44/568 |
| 5,310,494 | 5/1994 | Bennett | 252/88.1 |

*Primary Examiner*—Alan Diamond
*Attorney, Agent, or Firm*—Bruce E. Dahl, Esq.; Dahl & Osterloth LLP

[57] ABSTRACT

A composition and method for applying to a coal product for dust suppression, water repellency, and spontaneous combustion potential reduction. The composition includes molasses and a hydrocarbon-based solution, such as an oil-containing solution. The oil-containing solution is substantially free of water and may comprise about 20% asphalt. Both the molasses and the oil-containing solution may comprise at least about 40% of the total composition by weight. The method of applying the composition includes reducing a moisture content of a plurality of pieces of coal, cooling the plurality of pieces of coal after said reducing step and treating the plurality of pieces of coal after the reducing step, with a composition comprising an oil and molasses.

18 Claims, 4 Drawing Sheets

MOLASSES/OIL COAL TREATMENT FLUID AND METHOD

FIELD OF THE INVENTION

The present invention generally relates to the processing of carbonaceous materials. More particularly, the present invention relates to a composition which can be applied to the surface of a carbonaceous material, such as coal, to suppress the formation of dust, improve moisture repellency, and/or reduce air flow therethrough to reduce the potential for spontaneous combustion of the coal product during the processing and/or storage thereof The present invention also relates to a method for applying the composition to the carbonaceous material.

BACKGROUND OF THE INVENTION

In the processing of raw coal, it is generally considered beneficial to reduce the moisture content of low-rank coals (e.g., lignite and subbituminous coals) prior to shipment to the customer. Such reduced moisture content upgrades the low-rank coal to enhance the coal product heating value and decreases the weight of the coal to decrease transportation costs.

Removal of surface moisture and interstitial moisture from low-rank coals has the undesirable effect of increasing particle friability and dustiness during handling. Some dustiness also occurs due to loss of surface moisture by natural means during mining, preparation and storage. The presence of dust is undesirable in that it impairs visibility, is harmful if inhaled for long periods of time, and can result in loss of coal product. More significantly, dustiness can also result in spontaneous combustion during shipment and/or storage of the coal product.

Dust suppressants have been developed for reducing the dustiness of coals and thereby reducing the incidence of spontaneous combustion. Some dust suppressants are also designed to provide a relatively moisture repellant coating on the coal product, thereby inhibiting moisture reabsorption into the dry coal product which would reduce the product heating value. For example, petroleum-based fluids have been applied to coal particles (i.e., sprayed or immersed) to reduce the dustiness of and provide a moisture repellant coating to the coal product. However, petroleum-based fluids can be expensive, typically have high sulfur content, and can have low viscosities resulting in run-off. Molasses has also been utilized as a dust suppressant. Molasses is readily available and is low in cost, but lacks sufficient moisture repellency to be considered alone as a high-grade coal dust suppressant.

Based upon the foregoing, there is a need for an improved dust suppressant which can be economically applied to coal products to inhibit dust formation and improve moisture repellency of the coal product. The composition should have a high static viscosity at ambient temperature to inhibit run-off of the composition during long-term storage of the coal product. Further, the viscosity of the composition should substantially decrease with increasing temperature and increasing shear rate to facilitate application of the composition to the coal product.

SUMMARY OF THE INVENTION

The present invention achieves the above-stated requirements by providing a novel method and composition for treating coal products.

The composition generally comprises molasses and a hydrocarbon-based solution. In one embodiment, the molasses and the hydrocarbon portion of the hydrocarbon-based solution each make up between about 40% and about 60% of the composition by weight. In another embodiment, the hydrocarbon-based solution comprises an oil-containing solution which is substantially free of water. The oil-containing solution may comprise asphalt (e.g., up to about 50% of the solution by weight) to increase the viscosity of the composition. The oil-containing solution may advantageously be substantially free of volatile fractions so that hydrocarbon gases are not emitted during handling, transportation, or utilization. In order to inhibit run-off, the composition of the present invention preferably has a viscosity of at least about 50,000 cp at 70° F. In order to improve sprayability at elevated temperatures, the composition of the present invention preferably has a viscosity of less than about 3,000 cp at 150° F. The composition of the present invention may also exhibit significant shear thinning to facilitate application thereof to the coal product by high-shear application methods, such as spraying.

A method for applying the above-described composition is also disclosed. The method generally comprises the steps of reducing the moisture content of a plurality of pieces of coal by heating the same, cooling the plurality of pieces of coal, and treating the plurality of pieces of coal after the reducing step with a composition comprising molasses and an oil-containing solution. The reducing step occurs before the cooling step and preferably reduces the moisture content of the coal to less than about 10% by weight. The cooling step preferably reduces the temperature of the coal to less than about 125° F. The treating step may be performed before or after the cooling step, but nonetheless is performed after the reducing step. When treating the coal, the composition may be heated to at least about 120° F. to reduce the viscosity thereof and facilitate application of the composition to the coal (e.g., by spraying). The treating step advantageously may form a coating of the composition on the coal and maintains a substantially uniform concentration of the molasses and oil throughout the coating.

DETAILED DESCRIPTION

The present invention is based upon the properties and performance characteristics of molasses and oil compositions applied to an upgraded coal product for dust suppression, moisture repellency, and/or spontaneous combustion potential reduction. It has been discovered that, when mixed in the proper ratios, molasses and oil compositions exhibit particularly desirable ambient viscosity, shear viscosity and high temperature viscosity characteristics which provide enhanced dust suppression and moisture repellency over the use of either molasses or oil alone, and which provide enhanced application capabilities.

Typical properties of the individual components utilized for developing the composition of the present invention are summarized in Table 1 below.

TABLE 1

Typical Properties of Molasses and Coal Treating Oil

| | Beet Molasses | Coal Treating Oil |
|---|---|---|
| Moisture, % | 20–30 | 0 |
| Sulfur, % | 0.3–0.8 | 3–5 |
| Viscosity at 70° F., cp | 2,000–30,000 | 5,000–25,000 |
| Density, lb/gal | 10–12 | 8–9 |

In the described embodiment, the molasses component comprises beet molasses supplied by either the Holly Sugar Corporation or the Western Sugar Company. The molasses generally comprises about 50 percent sugar, about 25 percent moisture, and about 25 percent proteins and dissolved salts. It should be appreciated that the molasses component of the present invention is not limited to beet molasses, and may instead include cane molasses or other syrups or sugars. However, as will be discussed below, the use of sugar alone in combination with oil has problems with separation.

The oil component of the present invention is a hydrocarbon-based solution. Preferably, the oil exhibits little or no volatility at ambient temperature so that hydrocarbon gases are not emitted during handling, transportation or utilization. In the described embodiment, the oil comprises a petroleum-derived coal treating oil supplied by Conoco, Inc. (Product Code 1060). The Conoco oil comprises an aromatic hydrocarbon oil, such as decant oil, mixed with about 20 percent asphalt material, such as a 100 penetration asphalt obtained during conventional petroleum refining. The Conoco oil is described in more detail in U.S. Pat. No. 4,201,657 to Anderson et al., which is incorporated herein by reference. Other oils may be used, including coal-derived, plant-derived, and animal-derived oils.

Figure 1:
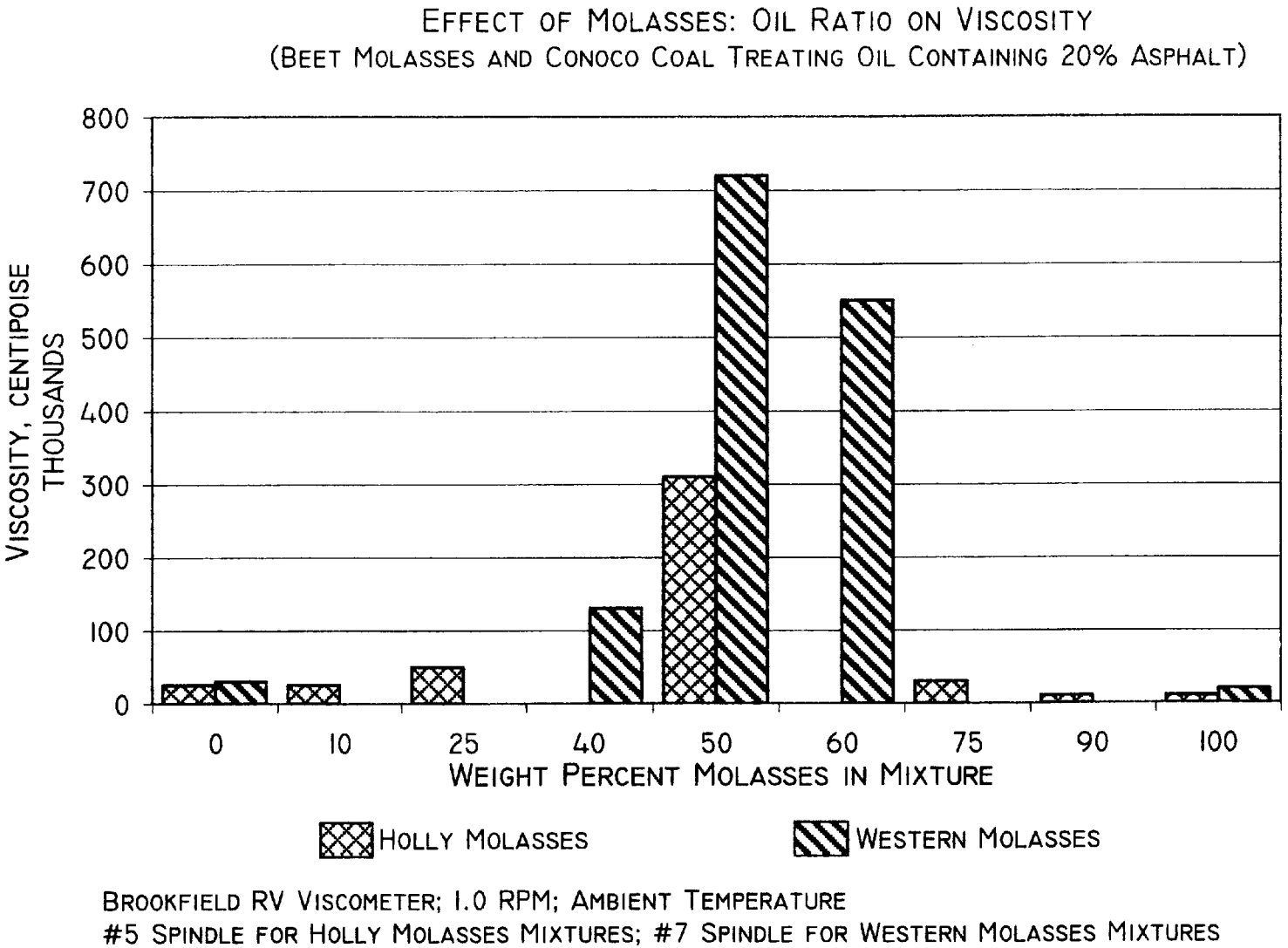
FIG. 1 is a chart illustrating the change in composition viscosity with changing weight percent molasses.

It has been discovered that blends of beet molasses and oil produce a thick liquid which is of greater viscosity than either component individually. FIG. 1 illustrates the effect of the molasses:oil ratio on composition viscosity. Compositions containing between 40 percent and 60 percent molasses and oil exhibit significantly greater viscosities than the individual components alone. More specifically, such compositions have viscosities well in excess of 100,000 cp at 70° F., while the individual components have maximum viscosities on the order of about 30,000 cp at 700° F. Equal parts of the two components result in substantially greater viscosity than other mixtures tested (i.e., on the order of about 700,000 cp at 70° F. for a 50:50 mixture of Western molasses and Conoco coal treating oil containing 20 percent asphalt). Without being limited to a particular theory, it is believed that the unexpected extreme increase in viscosity may be due in part to hydrogen-bonding interactions between the oil and molasses. It is this increased viscosity of the molasses and oil compositions which constitutes one of the desirable aspects of the present invention.

Figure 2:
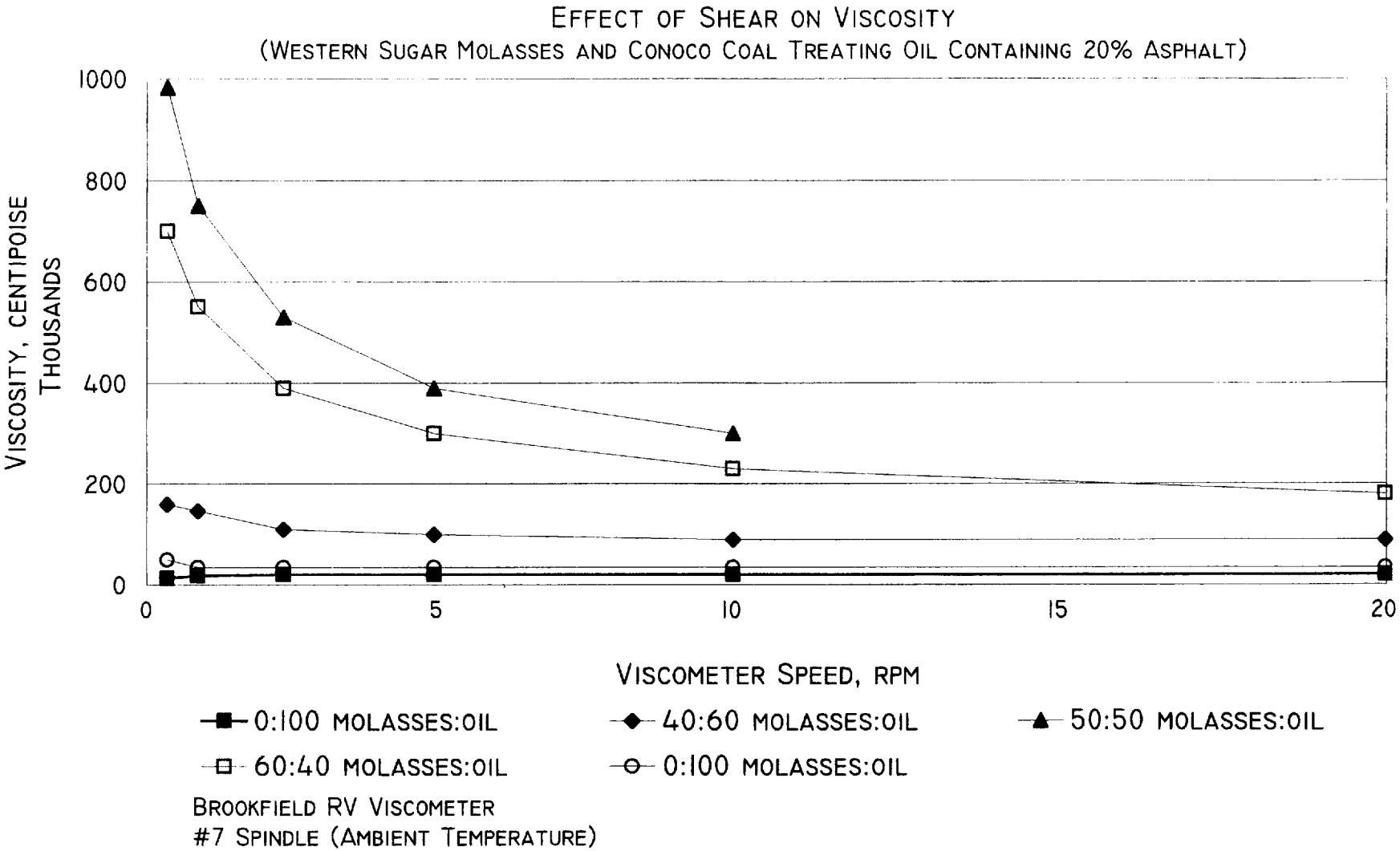
FIG. 2 is a graph illustrating the effect of shear on the viscosity of various compositions.

The Conoco oil and Holly and Western molasses components each individually exhibit nearly Newtonian rheological behavior. This characteristic is reflected in the observation that viscosity remains nearly constant as a function of shear rate, as illustrated in FIG. 2. Blends of molasses and oil containing greater than about 40 percent and less than about 60 percent molasses, however, exhibit significant shear thinning, or pseudoplastic rheological behavior. This desirable characteristic leads to relatively low viscosity (i.e., compared to the viscosity at low shear) under the high shear conditions which are encountered in spray nozzles. As a result, good atomization and coverage of the treatment composition onto coal is possible. The characteristic of decreasing viscosity as a function of increasing rotational speed of the viscometer spindle, as illustrated in FIG. 2, is indicative of shear thinning.

The same shear-thinning behavior leads to relatively high viscosity at low shear (i.e., when the treatment composition is at rest on the surface of the coal). As a result, the treatment remains near the particle surfaces after application and is available to capture additional dust which may be generated during subsequent handling. In addition, the high viscosity at low shear inhibits loss of treatment composition due to run-off during storage. However, as can be seen in FIG. 2 and as noted above, the viscosity of the composition of the present invention is significantly reduced by the shear forces imparted thereon during spraying. In one embodiment, the viscosity of the composition is reduced by at least 25 percent, and preferably by more than about 75 percent, during spraying by the noted shear-thinning effect which facilitates the application of compositions of the present invention onto the coal product.

Figure 3:
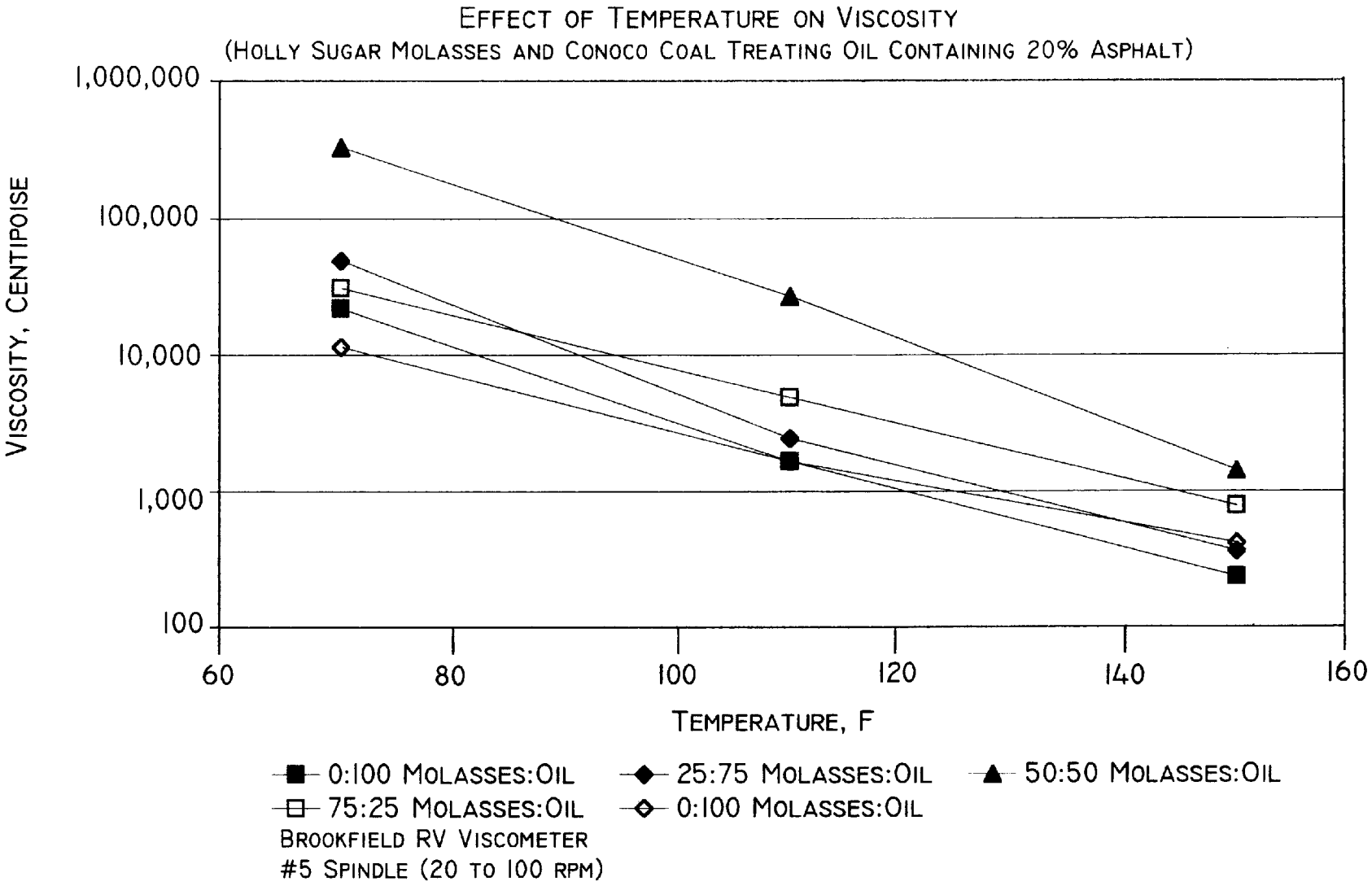
FIG. 3 is a graph illustrating the effect of temperature on the viscosity of various compositions.

The viscosities of molasses, oil, and blends of molasses and oil all decrease with increasing temperature as illustrated in FIG. 3. However, the rate of viscosity decrease with an increase in temperature is greater for compositions in accordance with principles of the present invention. This desirable feature allows the treatment composition of the present invention to be heated and thereby thinned during spraying for improved atomization and product coverage. FIG. 3 specifically illustrates an example of viscosity decrease as a function of increasing temperature exhibited by blends of Holly beet molasses and Conoco oil containing 20 percent asphalt. Viscosity decreased by roughly two orders of magnitude when temperature increased from 70° F. to 150° F. for all molasses:oil blend ratios tested For example, the 50:50 ratio sample decreased in viscosity from about 300,000 cp at 70° F. to about 2,000 cp at 150° F. The optimum spraying temperature can be resolved for any particular treatment application by experimentation. However, in one embodiment, the temperature of the composition when sprayed ranges from about 150° F. to about 1700° F.

Thickeners and additives may be added to increase viscosity of the composition. For example, in the examples noted above, Conoco 85100 asphalt was added to the Conoco oil at a concentration of about 20 percent prior to blending with molasses. The oil exhibited a viscosity increase of about a factor of three as a result of the asphalt addition. Both the Conoco oil and the Conoco oil with asphalt exhibit nearly Newtonian rheological behavior (no shear thinning).

Similarly, sugar may be added to the oil to increase viscosity. In one example, sugar was added to Conoco oils with and without asphalt at a concentration of about 30 percent by weight. In each case, viscosity increased by a factor of about two. Nearly Newtonian rheological behavior was observed in each case after sugar addition. Other additives including, but not limited to, waxes and polymers may be included to tailor viscosity and tackiness to a particular application.

Surprisingly, the blending of molasses and oil results in a stable mixture which exhibits the desirable property of little or no separation during storage and handling. That is, the mixture is substantially homogeneous and remains so even when on the coal product. Molasses blended with oil across all ratios tested in the examples noted above exhibited no apparent separation. By contrast, a mixture of sugar and water (1:1 ratio by weight) was prepared and then blended with Conoco oil at a ratio of one part sugar water to one part oil. The resulting mixture exhibited rapid separation of the water and oil components. Additives including, but not limited to, surfactants and emulsifiers may be added to optimize mixture characteristics for particular types of syrups and oils. However, in the case of the oil and molasses composition, no emulsifiers are needed for mixing the oil and molasses into a substantially homogenous mixture.

As may be evident from the above description of the composition, the preferred method of application of the composition to the coal product is spraying. For example, the composition may be heated to between about 50° F. and 250° F. to decrease the viscosity of the composition and sprayed through a known spray nozzle. As noted, in one embodiment, the composition is heated to a temperature of about 150° F. to about 170° F. before spraying. However, it should be appreciated that other methods of application may be utilized. For example, the coal product may be immersed in a bath of the composition and subsequently removed therefrom to provide composition coverage over the surface of the coal product. Moreover the composition may be applied in a blender such as the PK Zig-Zag® Continuous Blender by Patterson-Kelley Co. of East Stroudsbury, Pa. Furthermore, the coal product may be treated in coal transfer chutes or at the discharge of conveyors.

The effectiveness of a particular dust suppressant can be measured utilizing an opacity meter. The opacity meter is based on the principle of light transmittance through a cloud of dust created when approximately 200 grams of sample are dropped into a vertical cylinder chamber of approximately 4 inches in diameter and 32 inches in length. A laser provides a beam of light which is passed through the dust cloud to a photo detector. Light transmittance at a period of time after dropping a test sample into the chamber is used as a relative indicator of sample dustiness. Samples may be tested as-produced and also after tumbling in an apparatus and procedure as described in ASTM D-441, Friability Test for Coal. Experience has shown that the tumbling procedure provides conditions which a raw coal or upgraded coal product must endure in the laboratory without significant dust production in order to be handled and transported industrially.

Table 2 below shows results of laboratory tests performed to illustrate the relative dustiness of raw coal ("as is" from the mine), upgraded (dried) coal product, and upgraded (dried) coal product treated with a commercial petroleum-based spray agent. The raw coal and products shown in Table 2 were produced at a nominal minus ¾-inch particle size containing significant fractions of fine material (less than ¼ inch). The table provides the moisture content of each freshly prepared coal or coal product and the dustiness based on opacity reader meetings taken as described above.

TABLE 2

Effect of Drying and Treatment on Subbituminous Coal Dustiness

| | Product | Opacity Test Result, % Light Transmittance, 15 Seconds After Dropping Sample[a] | |
|---|---|---|---|
| | % $H_2O$ | As Produced | After Tumbling[b] |
| Raw Coal | 30.8 | 100.0 | 100.0 |
| Dry, Untreated Coal | 9.4 | 82.9 | 26.7 |
| Dry, Oiled Coat[c] | 9.9 | 98.4 | 100.0 |

[a]100% = No dust.
[b]Using ASTM D-441 tumbler apparatus.
[c]Treated with 6 gallons Conoco coal treating oil per ton of product.

As can be seen in Table 2, the raw coal sample exhibited no dustiness. This is a result of the saturation of internal coal pores with moisture and the presence of surface moisture, which acts to adhere coal fines. During industrial-scale drying of a similar raw coal, total moisture was reduced from approximately 30 percent to less than 10 percent. The untreated, upgraded coal product exhibited significant dustiness, particularly following the tumbling procedure described above. A similar upgraded coal produced was treated with Conoco coal treating oil using an application rate of six gallons per ton with the result that dustiness was nearly eliminated.

Table 3 compares laboratory dustiness data using various potential alternative dust suppressants. Industrially produced upgraded coal was treated in the laboratory at a rate of six gallons treatment composition per ton of product. These test results show that beet molasses alone did not perform as well as Conoco oil alone for suppression of dust at a comparable application rate. Slight dilution of the molasses resulted in a significant improvement of results; however, performance was still noticeably poorer than oil alone. A freshly prepared product treated with a 1:1 oil:molasses mixture provided dustiness results which nearly matched those of the oil alone.

TABLE 3

Effect of Treatment on Dry Subbituminous Coal Dustiness (6 Gallons Per Ton Application Rate for Each Treatment)

| | Product | Opacity Test Result, % Light Transmittance, 15 Seconds After Dropping Sample[a] | |
|---|---|---|---|
| Treatment Type | % $H_2O$ | As Produced | After Tumbling[b] |
| Conoco Coal Treating Oil | 9.9 | 98.4 | 100.0 |
| Beet Molasses | 9.9 | 95.2 | 83.7 |
| 10:1 Molasses:Water | 10.0 | 97.1 | 97.6 |
| 1:1 Oil:Molasses | 9.5 | 98.6 | 99.2 |

[a]100% = No dust.
[b]Using ASTM D-441 tumbler apparatus.

Table 4 below summarizes results obtained from coal and upgraded products following treatment with oil, molasses, and a blend of oil and molasses on an industrial scale. Results are shown for products as-produced and after stockpiling. The coals shown in Table 4 were stockpiled for a few weeks prior to sampling. The tests were conducted during different industrial scale test operations. In general, stockpiling of coal or products results in degradation due to moisture changes and oxidation. Temperatures monitored in the stockpiles showed that all products exhibited some self heating. Previous experience has shown that many untreated upgraded products cannot be stockpiled without sealing surfaces to block airflow. Untreated products will often produce heat from oxidation and will eventually exhibit spontaneous combustion in locations where heat is generated at a rate greater than it is dissipated. Treated products in these examples exhibit heating but at a much lower rate due to physical and chemical effects of product pore blockage by the treatments.

TABLE 4

Effect of Treatment Type and Stockpiling on Dry Coal Dustiness

| | As Produced | | After Stockpiling | |
|---|---|---|---|---|
| Coal and Treatment Type | Product % $H_2O$ | Opacity Test Result, % Light Transmittance, 15 Seconds After Dropping[b] | Product % $H_2O$ | Opacity Test Result, % Light Transmittance, 15 Seconds After Dropping[b] |
| Raw Coal, Untreated | 29.5 | 99.9 | 23.8 | 21.6 |
| Dry, Oil Treated | 9.9 | 100.0 | 12.1 | 90.3 |

TABLE 4-continued

Effect of Treatment Type and Stockpiling on Dry Coal Dustiness

| Coal and Treatment Type | As Produced | | After Stockpiling | |
|---|---|---|---|---|
| | Product % $H_2O$ | Opacity Test Result, % Light Transmittance, 15 Seconds After Dropping[b] | Product % $H_2O$ | Opacity Test Result, % Light Transmittance, 15 Seconds After Dropping[b] |
| Dry, Treated Molasses | — | — | 12.5 | 63.2 |
| Dry, Treated Molasses/Oil | 10.8 | 100.0 | 5.3 | 97.1 |

[a]All treated coals received an application of about 6 gallons per ton.
[b]100% = No dust.

The results in Table 4 show that the raw coal became very dusty after stockpiling due to loss of moisture. Removal of surface moisture liberated fines which had been adhering to the particle surfaces. The oil-treated upgraded product also exhibited an increase in dustiness (i.e., light transmittance decreased from 100.0 to 90.3 percent) during stockpiling while exhibiting an increase in moisture content from 9.9 to 12.1 percent. It is thought that oxidation of the product rather than moisture changes are responsible for the increased dustiness of this product.

A similar product treated with molasses was not sampled as-produced for dustiness testing but was initially produced at about 10 to 11 percent moisture and contained very little dust based on visual observation. After stockpiling, a significant dustiness was measured (i.e., light transmittance value of 63.2 percent) even though moisture content increased somewhat.

A similar upgraded product, which was treated with a blend of molasses and oil, exhibited the smallest increase in dustiness of all coals or products tested following stockpiling. Even though this product lost moisture during stockpiling (i.e., decreased from 10.8 to 5.3 percent), dustiness showed only a slight drop from the as-produced value.

A treatment application rate of 6 gallons per ton was selected for the series of tests described above. Depending on the particular nature of the coal or product, the application rate can be adjusted to provide the desired degree of dust control. An additional consideration in the overall application rate is the oil addition requirement to impart moisture repellency to the product. For example, moisture repellency can be induced in molasses and oil mixtures at an oil concentration lower than that required to induce favorable shear-thinning flow properties. In some applications, treatments containing low concentrations of oil will perform satisfactorily and may constitute an optimum formulation.

Figure 4:
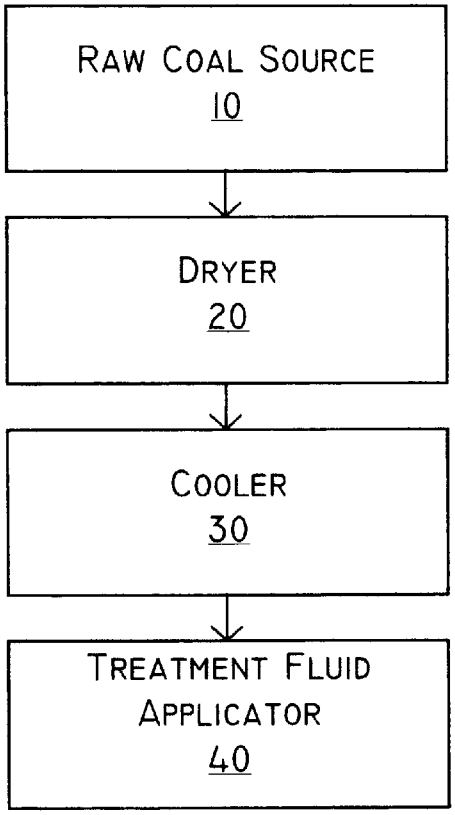
FIG. 4 is a block diagram of a general coal drying process in accordance with principles of the present invention.

The general methodology of producing a coal product in accordance with principles of the present invention is schematically illustrated in FIG. 4. Generally, a stream of raw coal (e.g., having a moisture content of about 30% by weight) is provided from a source 10 (e.g., a crusher or grinder) to a dryer 20 (e.g., a fluidized bed reactor). In the dryer 20, the moisture content of the raw coal therein is reduced to the desired degree (e.g., by passing a heated gas through the bed of coal). Thereafter, coal is removed from the dryer 20 and directed to a cooler 30 (e.g., another fluidized bed reactor) where the temperature of the "dried" coal is reduced to the desire degree (e.g., 125° F. and by, for instance, passing ambient temperature air through the coal in the cooler 30). After the desired temperature is achieved, the coal may be directed to a treatment fluid applicator 40 which applies a composition in accordance with principles of the present thereto to the coal. However, as noted above this composition may be applied in a variety of manners. Moreover, it should be noted that although the composition is illustrated as being applied after exiting the cooler 30, broadly the present invention includes applying the composition at any time after "drying" the coal to the desired degree. A more detailed discussion of a coal drying process is disclosed in U.S. Pat. No. 4,354,825 to Fisher et al., the entire disclosure of which is incorporated by reference herein.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described hereinabove are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. A method for producing a coal product from raw coal, comprising the steps of:

heating the raw coal in a coal dryer;

reducing a moisture content of the raw coal using said heating step to produce dried coal;

cooling the dried coal after said reducing step; and treating the dried coal after said reducing step and all heating steps involved in producing the coal product from the raw coal with a liquid comprising oil and molasses to produce the coal product, wherein said oil and molasses are mixed together before said treating step to provide said liquid used by said treating step.

2. A method for producing a coal product as set forth in claim 1, wherein said reducing step comprises reducing the moisture content of the raw coal to less than about 10% by weight.

3. A method for producing a coal product as set forth in claim 1, wherein said cooling step comprises cooling the dried coal to less than about 125° F.

4. A method for producing a coal product as set forth in claim 1, further comprising the step of:

heating the liquid to a temperature between about 50° F. and about 250° F. before said treating step.

5. A method for producing a coal product as set forth in claim 4, wherein said step of heating the liquid increases the temperature of the liquid to a temperature between about 150° F. and about 170° F.

6. A method for producing a coal product as set forth in claim 1, wherein said treating step comprises forming a coating on the dried coal and maintaining a substantially uniform concentration of the oil and molasses throughout the coating.

7. A method for producing a coal product as set forth in claim 1, wherein said treating step comprises spraying the liquid into the dried coal.

8. A method for producing a coal product as set forth in claim 1, wherein said treating step comprises immersing the dried coal into the liquid.

9. A method for producing a coal product as set forth in claim 1, wherein the liquid has a viscosity before said treating step, and wherein said treating step comprises spraying the liquid, shearing the liquid during said spraying step, and reducing the viscosity of the liquid by more than about 25 percent during said shearing step.

10. A liquid for treating a coal product, comprising:

a mixture of molasses and a hydrocarbon-based solution, wherein:

said molasses is present in the amount of at least about 40% of said liquid by weight; and said hydrocarbon-based solution comprises a hydrocarbon portion wherein said hydrocarbon portion comprises at least about 40% of said liquid by weight, and wherein said molasses and said hydrocarbon-based solution are mixed before being used in the treatment of the coal product.

11. A liquid for treating a coal product as set forth in 10, wherein said hydrocarbon-based solution is substantially free of water.

12. A liquid for treating a coal product as set forth in 10, wherein said hydrocarbon-based solution comprises asphalt.

13. A liquid for treating a coal product as set forth in claim 12, wherein said asphalt makes up about 20% of said hydrocarbon-based solution by weight.

14. A liquid for treating a coal product as set forth in 10, wherein said hydrocarbon-based solution is substantially free of volatile fractions.

15. A liquid for treating a coal product as set forth in 10, wherein said liquid has a viscosity of at least about 50,000 centipoise at 70° F.

16. A liquid for treating a coal product as set forth in claim 15, wherein said liquid has a viscosity of less than about 3,000 centipoise at 150° F.

17. A liquid for treating a coal product as set forth in claim 10, wherein said liquid has a viscosity of at least 300,000 centipoise at about 700° F.

18. A liquid for treating a coal product as set forth in claim 10, wherein said molasses and said hydrocarbon-based solution each comprise about 50% of said liquid on a weight percentage basis.

* * * * *

UNITED STATES PATENT AND TRADEMARK OFFICE

CERTIFICATE OF CORRECTION

PATENT NO : 6,086,647

DATED : July 11, 2000

INVENTOR(S) : Randall L. Rahm; Kevin B. Avery, Mark H. Berggren

It is certified that error appears in the above-identified patent and that said Letters Patent are hereby corrected as shown below:

IN THE CLAIMS:

In Column 10, line 16, change "700 F." to --70 F.--

Signed and Sealed this

Twenty-second Day of May, 2001

*Attest:*

Nicholas P. Godici

NICHOLAS P. GODICI

*Attesting Officer*

*Acting Director of the United States Patent and Trademark Office*